US005538001A

United States Patent [19]

Bridges

[11] Patent Number: 5,538,001

[45] Date of Patent: Jul. 23, 1996

[54] OXYGEN MASKS

[75] Inventor: Peter C. Bridges, Ushott, United Kingdom

[73] Assignee: The Secretary of State for Defence in Her Britannic Majesty's Government of the United Kingdom of Northern Ireland and Great Britain, London, England

[21] Appl. No.: 351,306

[22] PCT Filed: Jun. 7, 1993

[86] PCT No.: PCT/GB93/01202

§ 371 Date: Jan. 26, 1995

§ 102(e) Date: Jan. 26, 1995

[87] PCT Pub. No.: WO93/25275

PCT Pub. Date: Dec. 23, 1993

[30] Foreign Application Priority Data

Jun. 12, 1992 [GB] United Kingdom ..... 9212571

[51] Int. Cl.[6] ..... A62B 18/02

[52] U.S. Cl. ..... 128/206.24; 128/201.23; 128/202.11; 128/205.25; 2/2.14; 600/20

[58] Field of Search ..... 128/205.25, 206.21, 128/206.23, 206.24, 206.28, 207.11, 202.11, 201.23, 201.22, 201.24; 2/2.14, 2.11; 600/19, 20

[56] References Cited

U.S. PATENT DOCUMENTS

| | | | |
|---|---|---|---|
| 2,827,900 | 3/1958 | Marietta | 128/206.28 |
| 3,513,841 | 5/1970 | Seeler | 128/201.23 |
| 3,910,269 | 10/1975 | Ansite et al. | 128/201.24 |

FOREIGN PATENT DOCUMENTS

| | | | |
|---|---|---|---|
| 2375873 | 7/1978 | France . | |
| 2657264 | 7/1991 | France . | |
| 826198 | 12/1959 | United Kingdom . | |
| 92/00120 | 1/1992 | WIPO | 128/202.11 |

*Primary Examiner*—Edgar S. Burr
*Assistant Examiner*—Eric P. Raciti
*Attorney, Agent, or Firm*—Nixon & Vanderhye

[57] ABSTRACT

A pressure breathing mask, particularly an aircrew oxygen mask, includes an exoskeleton (10), a flexible facepiece (11) with an oxygen delivery connection (15), an inflatable bladder (20) positioned between the exoskeleton (10) and a rigid intermediate member (30), the intermediate member (30) bearing on the facepiece (11), and means (21, 23) for automatically inflating the bladder (20) when oxygen is delivered under pressure to the mask.

7 Claims, 3 Drawing Sheets

OXYGEN MASKS

BACKGROUND OF THE INVENTION

The present invention relates to pressure breathing masks such as oxygen masks used by military aircrew.

DISCUSSION OF PRIOR ART

It is well known that human life relies on the absorption of oxygen by the lungs. For absorption to take place the partial pressure of oxygen in the lungs must be above a certain minimum pressure.

It is also well known that one effect of increasing altitude is a reduction in air density (and hence in air pressure). To compensate for this effect aircrew are provided, through specially designed masks, known as oxygen masks, with an air supply having an enhanced, eventually pure, oxygen content. However an altitude, normally about 37,000 feet, is eventually reached where the pressure of even pure oxygen is insufficient for it to be absorbed. To overcome this problem aircraft cabins are pressurised.

The effect of loss of pressure in the cabin of an aircraft flying above the critical altitude is that occupants of the cabin rapidly become hypoxic (from lack of oxygen) and the consequent loss of consciousness can occur very quickly. To cope with this eventuality, systems have been developed whereby loss of cabin pressure results in the supply to oxygen masks of pure oxygen at increased pressure relative to ambient pressure, sufficient for it to be absorbed by the lungs in an amount sufficient to prevent hypoxia. For this pressurised breathing to be effective, an oxygen mask must clearly form a gas tight seal with its wearer's face. Masks held in position sufficiently tightly to fulfil this condition would be unbearably uncomfortable at this tightness, so masks have been developed which can be tightened when the wearer notices the onset of pressure breathing. Currently used masks each have a rigid exoskeleton, normally of a Fibre (usually glass fibre) Reinforced Plastic Material, to which is attached a flexible face piece. It is, of course, essential that the face-piece be flexible to allow it to remain in sealing contact with a wearer's face despite the inevitable changes in contour of the face (due, for example, to the effects of talking and to the effects of gravitational forces during manoeuvring of the aircraft). The exoskeleton is attached to a helmet by a mechanism which can be tightened to bring the facepiece into tighter contact with a wearer's face. The conventional arrangement includes a toggle bar which the wearer moves physically with his fingers.

Over recent years, pressure breathing has been introduced to help counter the effects of acceleration, in addition to the traditional role as a protection against hypoxia at high altitude. Thus, modern high speed aircraft, particularly military fighter aircraft, have reached a state of development where the gravitational forces imposed on their crew can reach levels where, were pressure breathing to be introduced whilst manoeuvring, the physical task of tightening the oxygen masks would be difficult or even impossible. There are known oxygen masks designed to tighten automatically when pressure breathing is applied, but these are complicated and expensive, relying on a bladder system, positioned at the rear of the helmet, which upon inflation re-orientates the helmet position and alters the whole geometry of the whole helmet/mask system. Such a system is described in UK Patent GB-B-826,198. However with this system a comparatively large bulk (helmet and mask) has to be moved. There can also be a detrimental effect upon any helmet mounted device such as, for example, a weapons sight or visual display.

In a more robust system, as described in Application PCT/GB91/01034 (published as WO 92/00120) an inflatable bladder is positioned between the rigid exoskeleton and the flexible face piece.

SUMMARY OF THE INVENTION

According to the present invention a pressure breathing mask includes a rigid exoskeleton, means for attaching the exoskeleton to a helmet, a flexible facepiece with a gas delivery connection, inflatable means positioned between the exoskeleton and the facepiece, and means for automatically inflating the inflatable means when gas is delivered under pressure to the mask characterised in that a rigid intermediate member conforming to the general configuration of the flexible facepiece and bearing against the facepiece is used to convey the effects of inflating the inflatable means to the facepiece.

The mask will usually be an oxygen mask, the inflatable means will be a bladder and the gas will be oxygen.

The applicant has discovered that by using the rigid intermediate member improved operation is achieved. The degree of flexibility of the facepiece inevitably varies over its surface and can result in disadvantageous distortion when the facepiece is in direct contact with an inflated bladder. It has also been found that the use of the rigid intermediate member does not disadvantageously affect the flexibility of the facepiece necessary for accommodating changes in facial contours.

The means for automatically inflating the bladder preferably comprise a connection to the oxygen delivery system.

BRIEF DESCRIPTION OF THE DRAWINGS

One embodiment of the invention will now be described, by way of example only, with reference to the accompanying diagrammatic drawings, of which.

DETAILED DESCRIPTION OF PREFERRED EMBODIMENTS

A conventional aircrew oxygen mask for use with a pressure breathing system has an exoskeleton 10, formed of, for example, Glass Fibre Reinforced Plastic (GRP) to which is secured a flexible facepiece 11 made from, for example, silicone rubber. The mask will normally contain radio transmission equipment at position 12, details of which are omitted for clarity.

Figure 2:
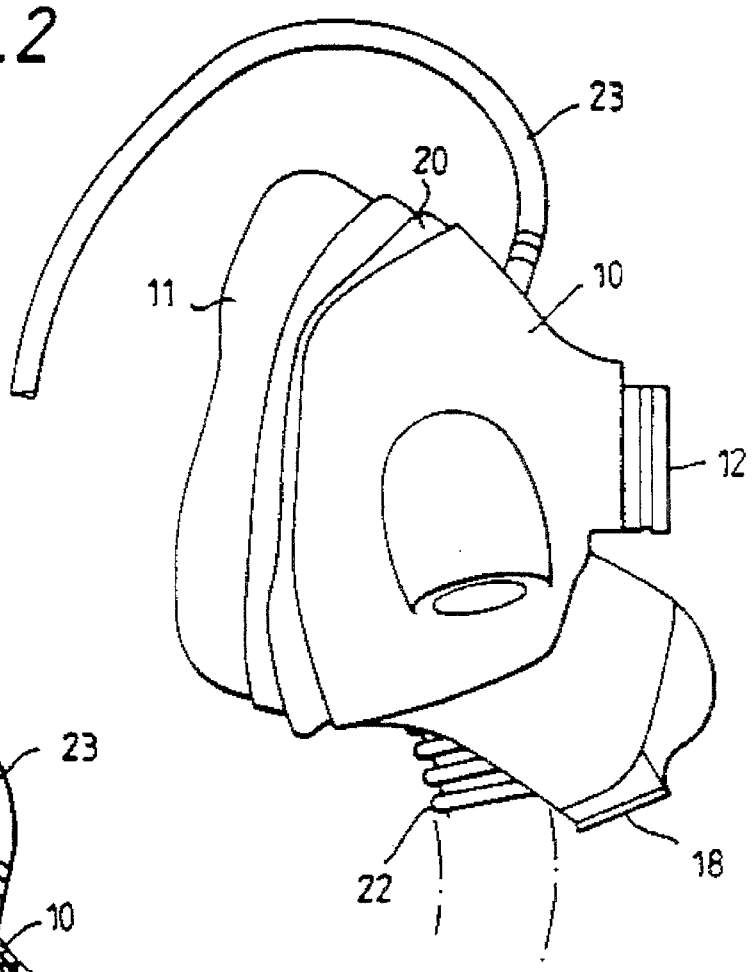
FIG. 2 is a side elevation of the mask shown in FIG. 1.

The exoskeleton 10 has oxygen tube access ports by means of one of which an oxygen tube can be connected via inlet 15 (FIG. 2) to the inside of the facepiece 11, and the exoskeleton 10 and facepiece 11 have exhaust valves 18, 19 respectively.

Figure 5:
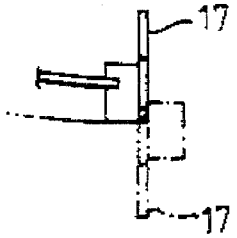
FIG. 5 is a sketch illustrating the operation of a tightening toggle of a conventional mask.

The mask exo-skeleton 10 of the mask has connecting chains 16 by means of which it can be secured to a helmet. The chains 16 are mounted on a toggle system 17 which, in use, can be rotated through 180 degrees (see FIG. 5) to tighten the facepiece, via the exo-skeleton, against the face of a wearer (not shown).

Figure 1:
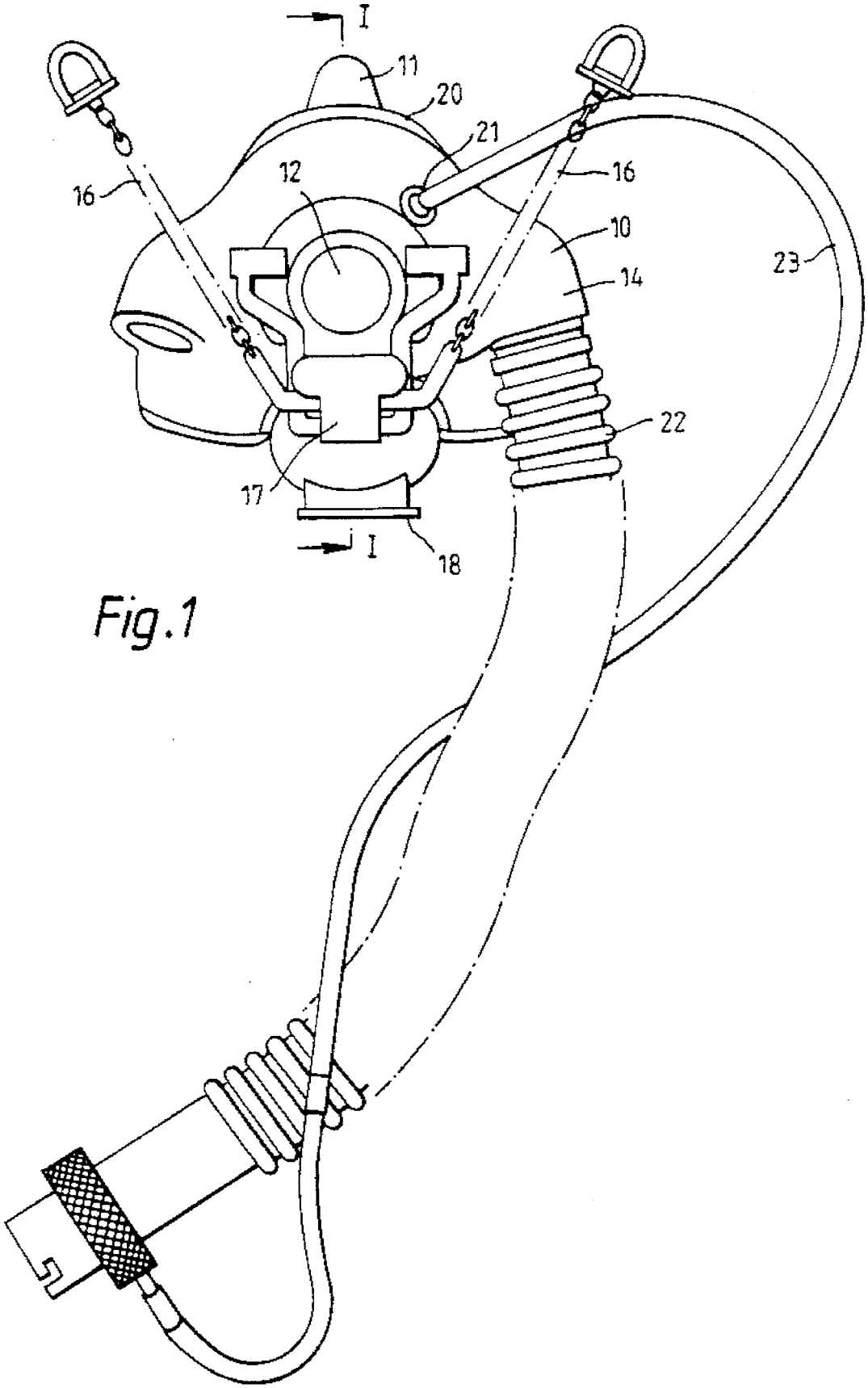
FIG. 1 is a front elevation of a mask according to the invention.
Figure 3:
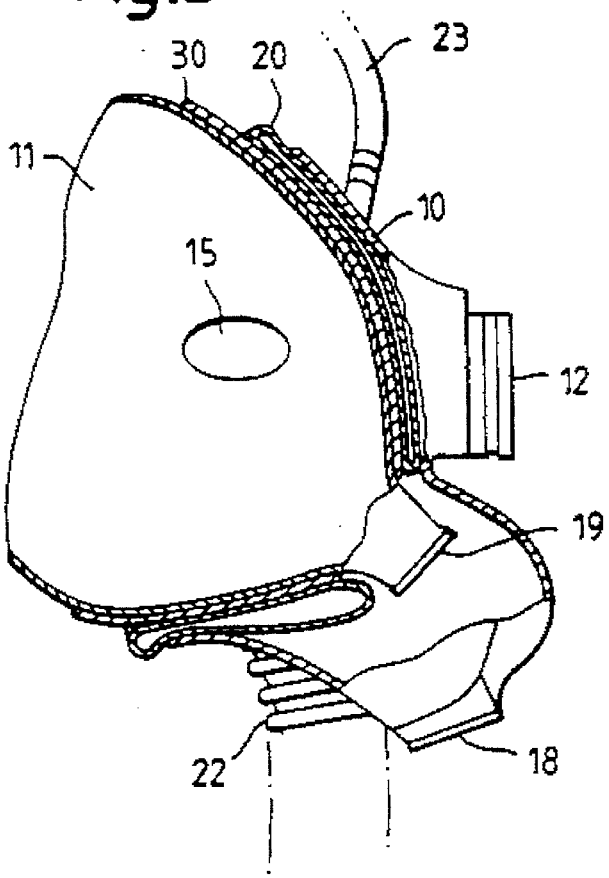
FIG. 3 is a side elevation, partly in section along line I—I of FIG. 1.
Figure 4:
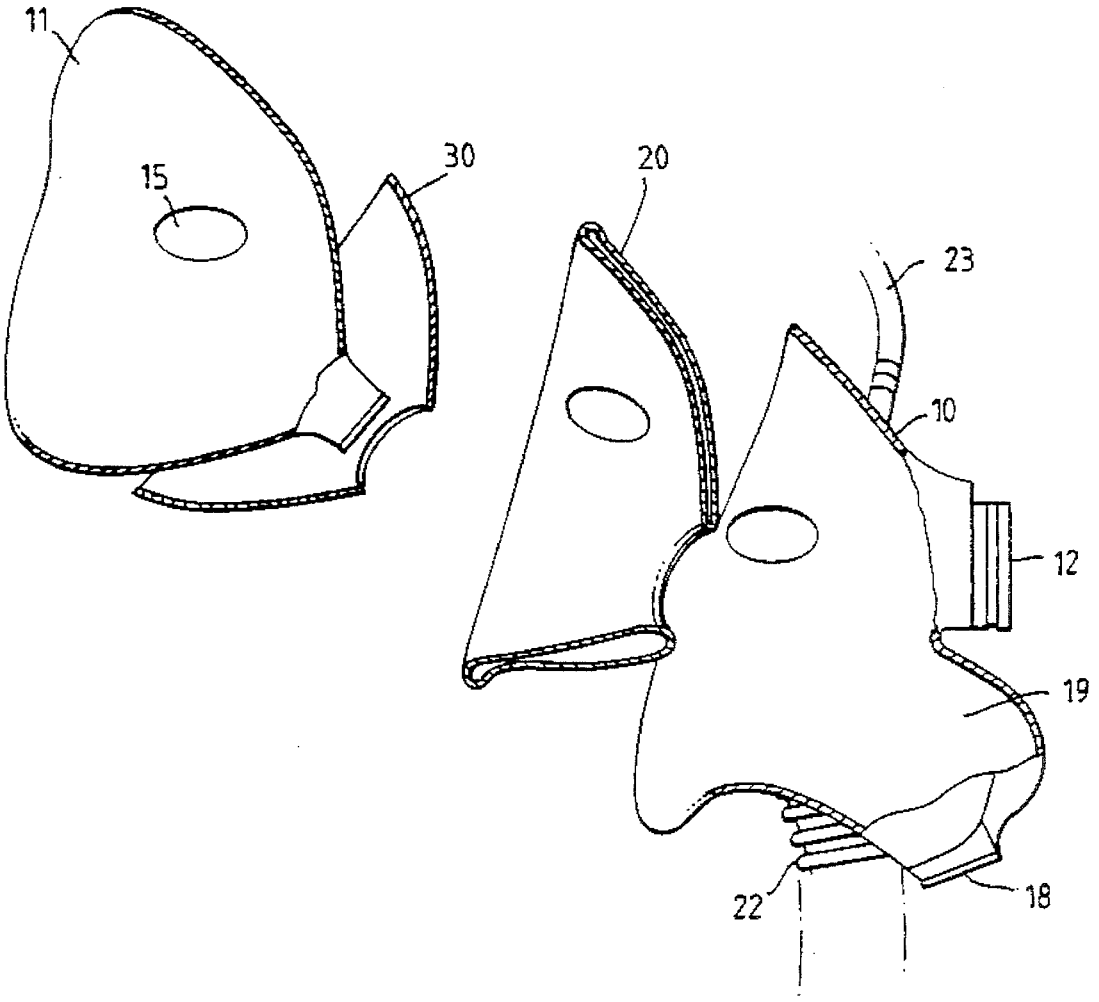
FIG. 4 is an exploded view of the side elevation of FIG. 3.

In a mask according to the invention (see particularly FIGS. 3 and 4) an inflatable bladder 20 is positioned between the exoskeleton 10 and a rigid intermediate member 30. The intermediate member 30 bears on the flexible facepiece 11. An connector 21 (FIG. 1) allows access to the bladder.

In use a wearer (not shown) dons a helmet (not shown) and attaches a mask to the helmet by means of the chains 16 in the usual way. An oxygen pipe 22 is connected to the facepiece 11 by means of the port 14, and is also connected by means of a tube 23 and the connector 21 to the bladder 20. Whenever the oxygen system switches to the pressure breathing mode oxygen under pressure will be supplied not only to the wearer via the inside of the facepiece 11 but also to the bladder 20. The bladder 20 will inflate, so forcing the intermediate member 30 against the facepiece 11, which results in the facepiece 11 being firmly held, without distortion from its basic shape, against the face of the wearer.

It will be realised that many variations are possible within the scope of the invention. For example an independent gas supply, preferably operated by the same actuation means as the pressurised oxygen supply, may be used for pressurising the bladder. Although more complicated, this arrangement allows for different pressurisation levels of the oxygen to the user and of gas to the bladder.

Whilst the chains 16 are illustrated as being attached to a toggle 17 this may be dispensed with in masks according to the invention, with the chains 16 being attached directly to the exoskeleton 10. Alternatively the toggle 17 may be retained as a back-up in case of failure of the bladder 20.

Versions of the mask other than for attachment to a helmet are possible.

Preferably the intermediate member 30 should cover the maximum area of the facepiece 11, though clearly some uncovered areas must remain to allow, for example, for an exhaust valve.

Whilst the invention is ideally suited to aircrew oxygen supply equipment it will be realised that it might also have applications to other pressure breathing apparatus such as respirators as used by firemen.

It will also be realised that whilst the mask has been described above as being separate from a helmet it may in fact be formed integral with the helmet, the chain 16 and toggle 17 being replaced by means effecting a permanent attachment between mask and helmet.

What is claimed is:

1. A pressure breathing mask including:

a rigid exoskeleton;

means for attaching the exoskeleton to a helmet;

a flexible facepiece with a gas delivery connection;

inflatable means positioned between the exoskeleton and the facepiece;

means for automatically inflating the inflatable means when gas is delivered under pressure to the facepiece; and a rigid intermediate member interposed between said inflatable means and said flexible face piece, said rigid intermediate member, conforming to the general configuration of the flexible facepiece, for bearing against the facepiece and for conveying the effects of inflating the inflatable means to the facepiece.

2. A pressure breathing mask as claimed in claim 1 wherein the inflatable means is a bladder.

3. A pressure breathing mask as claimed in claim 1 wherein the means for automatically inflating the inflatable means comprise a connection to a gas delivery system.

4. A pressure breathing mask as claimed in claim 1 wherein the exoskeleton is attached to the helmet by means of a chain.

5. A pressure breathing mask as claimed in claim 1 wherein the exoskeleton is attached to the helmet by means including a toggle arrangement.

6. A pressure breathing mask as claimed in claim 1 wherein said mask is an aircrew oxygen mask and said gas is oxygen.

7. A pressure breathing mask as claimed in claim 1 wherein the means for attaching the exoskeleton to a helmet comprises a means for making the mask integral with the helmet.

* * * * *